US005605396A

United States Patent [19]

Chin, Jr. et al.

[11] Patent Number: 5,605,396

[45] Date of Patent: Feb. 25, 1997

[54] APPARATUS AND METHOD FOR SECURING COMPONENT PANELS IN A TIERED LIGHTING FIXTURE

[75] Inventors: Paul W. Chin, Jr., Saratoga; Hsing M. Keng, Palos Verdes Estates, both of Calif.

[73] Assignee: Lite Corporation, Saratoga, Calif.

[21] Appl. No.: 243,232

[22] Filed: May 16, 1994

[51] Int. Cl.[6] ..... F21V 3/00

[52] U.S. Cl. ..... 362/367; 362/332; 362/360; 312/140; 403/217

[58] Field of Search ..... 312/140, 265.4; 403/170, 217; 248/220.1; 362/332, 360, 367, 455, 457, 458, 806, 808

[56] References Cited

U.S. PATENT DOCUMENTS

| | | | |
|---|---|---|---|
| 379,265 | 3/1888 | Best | 362/367 |
| 411,443 | 9/1889 | Hyman | 362/367 |
| 420,139 | 1/1890 | Barringer et al. | 362/367 |
| 1,393,050 | 10/1921 | Talley et al. | 312/140 |
| 1,398,852 | 11/1921 | Gilbert | 312/140 |
| 1,683,609 | 9/1928 | Dorey et al. | 362/367 |
| 1,818,404 | 8/1931 | Kaufman | 312/140 |
| 2,894,303 | 7/1959 | Armstrong et al. | 403/205 |
| 3,913,289 | 10/1975 | Recker | 312/140 |
| 4,277,822 | 7/1981 | Weber et al. | 362/352 |
| 4,295,187 | 10/1981 | Shemitz | 362/367 |
| 4,467,405 | 8/1984 | Weber | 362/352 |
| 4,493,425 | 1/1985 | Yoshida | 312/140 |
| 4,656,568 | 4/1987 | Reed | 362/360 |
| 4,688,155 | 8/1987 | Huang | 362/360 |
| 4,992,917 | 2/1991 | Earnshaw | 362/360 |

OTHER PUBLICATIONS

Catalog No. 106, Solid Brass Lighting Fixtures by Designers Fountain, Jul., 1989, pp. 1–42, 57–83, 91–160.

Catalog No. 107, Lighting Creations by Designers Fountain, Jan., 1993, pp. 27–208.

Catalog Supplement No. 107–3, Lighting Creations by Designers Fountain, 1994, pp. 10–13, 16–29.

*Primary Examiner*—Alan Cariaso

*Attorney, Agent, or Firm*—Albert C. Smith; Christopher M. Tobin

[57] ABSTRACT

A single or multi-tier lighting fixture includes intra-tier and inter-tier corner structures for connecting adjacent panels at their adjacent corners at predetermined angles to each other, within and across one or more horizontal tiers. The corner structures include sockets including flange members for straddling connection to opposite sides of the panels being connected. The adjacent ones of the sockets are attached to each other for connecting the adjacent panels in a single or multi-tier lighting fixture, and tiered structures include the corner structures which are adhesively connected to the panels in the lighting structure. The tiers of panels may be structurally supportable by rods and struts connecting tier support plates, or rings, and selected corner structures of the lighting fixture.

26 Claims, 8 Drawing Sheets

APPARATUS AND METHOD FOR SECURING COMPONENT PANELS IN A TIERED LIGHTING FIXTURE

TECHNICAL FIELD

This invention relates to methods and arrangements for securing lighting fixture component panels, and more particularly to methods and arrangements for securing component panels of a lighting fixture at adjacent corners of a tiered lighting fixture.

BACKGROUND OF THE INVENTION

Lighting fixture component panels may be flattened or curved pieces of material including glass which may have straight or curved edges and which may be wholly transparent or wholly or partially translucent or subject to varying temporal or permanent levels of opacity. The component panels may be, for example, triangular or rectangular or hexagonal pieces of glass which are completely transparent. In a functional arrangement, adjacent edges of hexagonal material serving as component panels may be assembled with edges aligned along their contiguous edges.

One known type of lighting fixture includes bound glass (BG) configurations. The term lighting fixtures means lighting appliances generally which are structurally fixed in place on a mounting surface or mobile or flee-standing appliance. The bound glass configuration provides a U-shaped metallic channel around the edges of each panel section to be joined into a cooperative lighting arrangement. The U-shaped channel is often not seamless. Rather the U-shaped channel is formed into a bound shape which joins the ends of the U-shaped channel at a corner of a component glass panel. However, some kinds of bound glass fixtures have experienced difficulties. Securing the ends of the U-shaped channels reliably, for example, using soldering techniques is difficult. Soldered connections at the ends of the U-shaped channels and between adjacent channels tend to break from time to time and are generally time-consuming to prepare properly.

It may be desirable to secure lighting fixture component panels with minimal structural complexity in reduced hardware structures.

SUMMARY OF THE INVENTION

The present invention is accordingly directed toward securing lighting fixture components panels having a plurality of corners at joinder points near adjacent corners and toward particular construction methods for making and assembling such structures. Joinder may be exclusively accomplished at the corners. According to a version of the invention, corner tabs are employed to join and secure selected fixture component panels at their corners. Joinder of the connecting tabs and the panel sections can be accomplished using selected glue, solder or epoxy. The present invention is additionally directed toward single and multi-tiered lighting structures having panels which are interconnected by specialized corner connectors. The panels may have obtuse and acute corners and parallel and non-parallel edges.

Within a single tier, the panels are connected in a series including first and last panels which are connected to each other to form a closed or ring-like segment as the particular tier. Each panel of the ring-like segment is connected to an adjacent panel at the adjacent corners thereof to form the tier of connected panels. Ring-like means in the general configuration or shape of a ring, including rings with gaps. The panels may be square, causing a particular tier to be generally cylindrical.

According to the present invention, a multi-tier lighting fixture includes a plurality of edge corner structures for connecting adjacent panels at predetermined angles to each other, within a single horizontal tier. The multi-tier lighting fixture further includes a plurality of inter-tier corner structures connecting adjacent panels in one tier at predetermined angles to adjacent panels in a successive tier. Further, each of the edge corner structures includes at least first and second sockets, and each of the inter-tier corner structures includes at least first through fourth sockets, and each of the first and second and first through fourth sockets includes first and second flange members for straddling connection to opposite sides of the panels being connected. Sockets in successive tiers are connected to each other for common support with the adjacent panels being attached by the sockets in an array that forms a multi-tier lighting fixture. A plurality of similar sized panel sections having edges and corners are arranged proximally at adjacent corners, and corner tabs are provided with at least a pair of flanged surfaces angled with respect to each other to conform to the surface inclinations at respective secured corners of the adjacent panels assembled into a multi-tiered fixture.

DETAILED DESCRIPTION OF THE PREFERRED EMBODIMENTS

Figure 1:
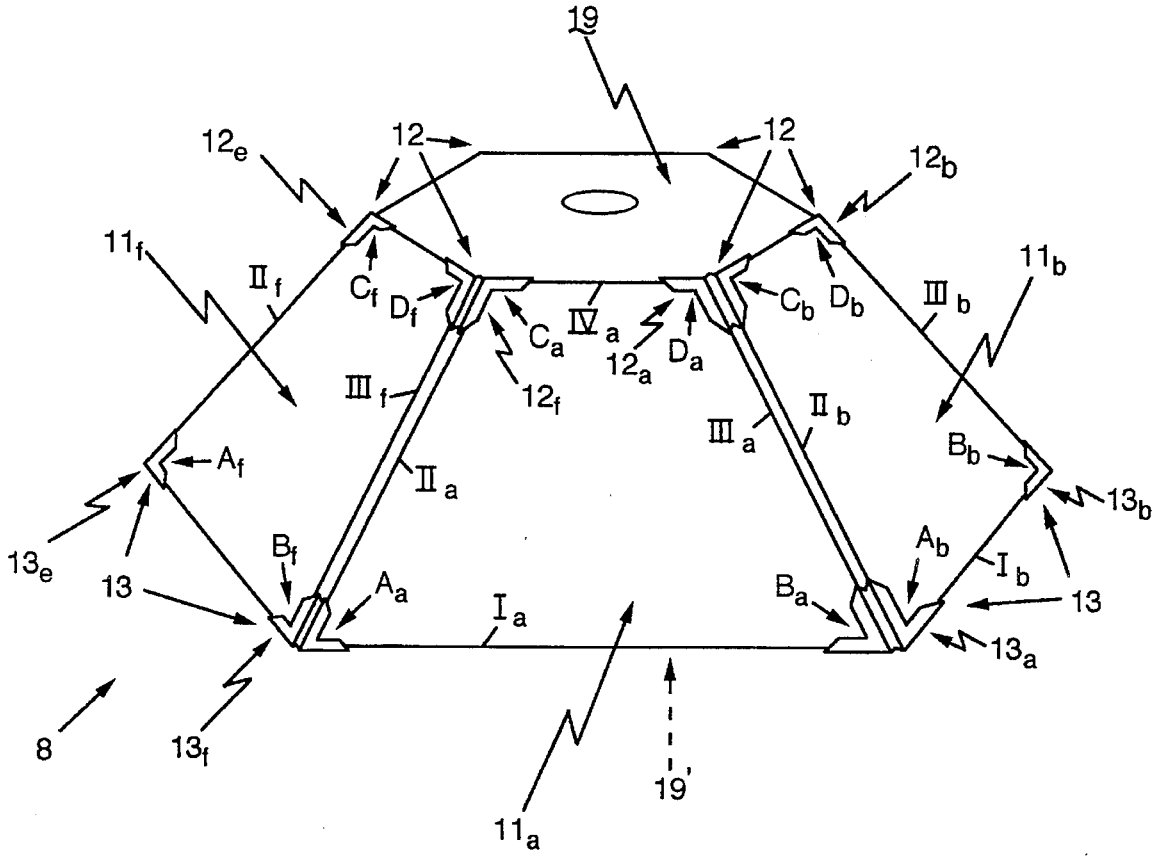
FIG. 1 shows a perspective view of a lighting fixture in accordance with one embodiment of the present invention.

FIG. 1 shows a perspective view of a lighting fixture 8 in accordance with one embodiment of the present invention. This embodiment includes a single-tiered, six-sided, hexagonal polyhedral structure including six panels respectively 11*a*–11*f* (panels 11*c*–11*e* on the backside of lighting fixture 8 not shown) and corner tabs 12 and 13. Panels 11*a*–11*f* are collectively referred to as panels 11 for convenience. The panels may have selected optical and physical properties including selected degrees of transparency and translucency, as well as shape, pigment, color, and opacity. Panels 11 are shown in the shape of truncated isosceles triangles to form symmetrical trapezoids. Each of the panels 11 shown has four corners and four edges, respectively designated by capital letters A–D for the corners, and I–IV for the edges. The edge and corner designations indicated may be provided with subscripts to indicate a particular corner of a particular panel, e.g., Ca for corner C of panel 11*a*, or IIIa for edge III of panel 11*a*. Alternatively, the corners and edges may be referred to generally without use of subscripts when the general case of the corner or edge is in discussion. Panels 11 of lighting fixture 8 are connected at their respective corners A–D with corner tabs 12 and 13. Corner tabs 12 are also referred to particularly as corner tabs 12*a*–12*f* in FIG. 1 (corner tabs 12*c* and 12*d* on the backside of lighting fixture 8 not being shown). Corner tabs 13 are also referred to particularly as corner tabs 13*a*–13*f* in FIG. 1 (corner tabs 13*c* and 13*d* on the backside of lighting fixture 8 not being shown).

Lighting fixture 8 in FIG. 1 further includes a flat plate 19 which is connected to corner tabs 12 as by soldering, glue, or epoxy, for example. Such solder, glue, or epoxy may be substituted by another suitable material, medium, or method which is effective for ensuring adhesive or adherent joinder between corner tab and panel. A preferred material is Duro MasterMend extra strength, quick set epoxy made by Loctite Corporation of Cleveland, Ohio. Flat plate 19 may be hexagonal in shape and may be fabricated of metal or glass or other suitable material. Lighting fixture 8 may further include a flat plate 19' (shown in phantom) which is connected to corner tabs 13 as by soldering, for example. Flat plates 19 and 19' may be hexagonal in shape and may be fabricated of a suitable metal or glass or other suitable material. The central portions of plates 19 and 19' may be cut or hollowed out, leaving the plates in the shape or form of a ring or frame, for example. Alternatively, wire-type frames or rings with or without radial wire spokes connected to a central ring or hub (for attaching conventional lighting components) may also be used. As can be seen with reference to FIG. 1, flat plate 19' would be larger in area than flat plate 19, to accommodate the separation of corner tabs 13 being separated from each other by greater distances than are corner tabs 12. Flat plate 19' may be provided with vertical support indirectly or directly from flat plate 19 through support rods, tubes, or ribs as will be discussed in greater detail below in connection with another embodiment of the invention. Such vertical weight bearing members can extend along the vertical junctions of adjacent panels between upper and lower plates, or can extend vertically inside or outside the hexagonal polyhedral structure, as more fully described later herein. In this illustrated embodiment, as well as in alternative embodiments of the present invention, as discussed below, it should be noted that the panels 11*a*–11*f* which are illustrated and described as generally flat panels may also have curved surfaces and non-straight edges within the scope of the present invention.

Figure 2:
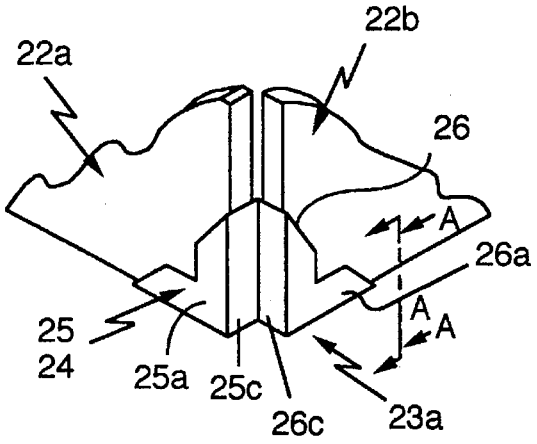
FIG. 2 shows first and second portions of adjacent panels connected at adjacent corners with a corner tab according to the present invention which features L-shaped sockets.
Figure 3:
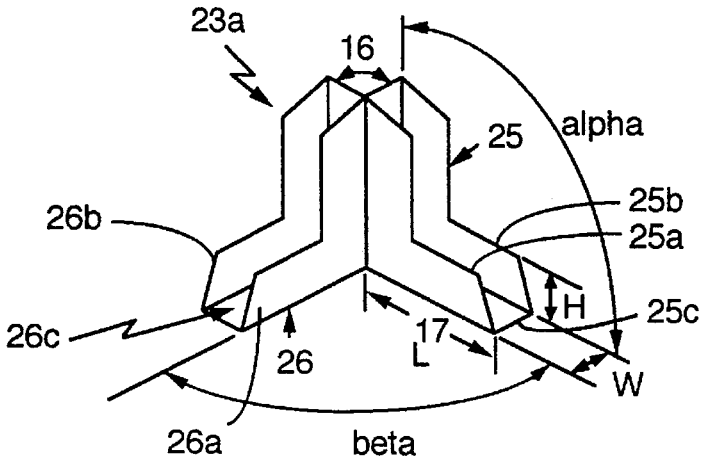
FIG. 3 shows a perspective view of details of the corner tab of FIG. 2 including L-shaped sockets.
Figure 4:
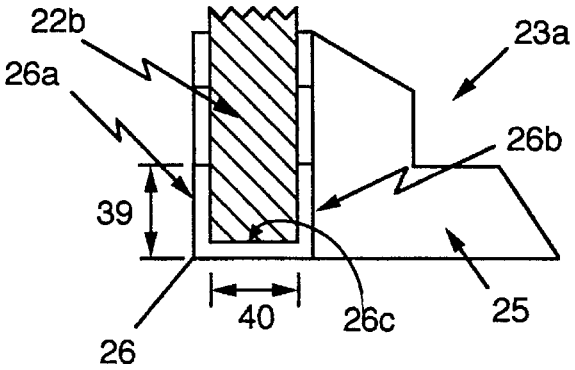
FIG. 4 shows a partial cross-section A of details in FIG. 2 illustrating how panel sections are received, secured, supported, and held in place in the bottom trough and sides of the L-shaped socket of a corner tab according to the present invention.

FIG. 2 shows first and second portions of adjacent panels 22*a* and 22*b* connected at adjacent corners Ba and Ab with a corner tab 23*a* according to the present invention. FIG. 3 shows a perspective view of details of the corner tab 23*a* of FIG. 2 including first and second L-shaped (in side profile) sockets 25 and 26. Angle alpha is an example of a panel corner angle. Angle beta is an example of a planar angle of inclination between adjacent panels. FIG. 4 shows a partial cross-section A of details in FIG. 2 illustrating how panel sections 22*a* and 22*b* are received, secured, supported, and held in place in the bottom trough and sides of L-shaped sockets, according to the present invention. Each of sockets 25 and 26 includes first and second flanges respectively 25*a*, 25*b*, and 26*a* and 26*b*. Further, each of sockets 25 and 26 includes a central base portion respectively 25*c* and 26*c*. Central base portions 25*c* and 26*c* include a generally vertical element and a generally horizontal element, against which the corners of panel sections 22*a* and 22*b* may bear when inserted between respective flanges 25*a*, 25*b*, or 26*a*, 26*b*, as the case may be. So positioned, the respective flanges straddle the corners of a panel in that the flanges are disposed on opposite sides of a panel. Each socket can be made separately, and then the two sockets can be attached, as by soldering at an edge thereof, for example. Alternatively, the combined corner sockets may be manufactured in one piece such as by one-piece moldings using conventional injection molding or die casting techniques, for example. The U-shaped cross-section of socket 26 of corner tab 23*a* is detailed in FIG. 4. The U-shaped cross section of socket 26 has a central section 26*c* of inside depth 39 and inside width 40. U-shaped cross section of socket 26 further includes sides including front and back portions of flanges 26*a* and 26*b*. As noted above, sockets 25, 26 may be L-shaped. In particular, each of flange sides 25*a*, 25*b*, and 26*a*, 26*b*, may be L-shaped including vertical and horizontal limbs of substantially equal lengths according to one embodiment of the invention. The vertical and horizontal limbs are joined at a proximal end, and each limb has side and distal edges. The distal and side edges may be variously angled from the limb axis. According to one embodiment, the distal edge angle with respect to the limb axis is 90 degrees. In other words, the distal edge is perpendicular to the limb axis. The limb axis may be parallel to the side edges. According to another embodiment, the distal edge may be fabricated at 45 degrees or at other selected angles from the limb axis. The corner tabs shown in FIGS. 2–4 are called doublets, because they connect only two corners of adjacent panels. The height of an L-shaped limb is indicated in FIG. 3 by a capital "H," the width between limbs, by capital "W," and the limb length, by capital "L."

Figure 5:
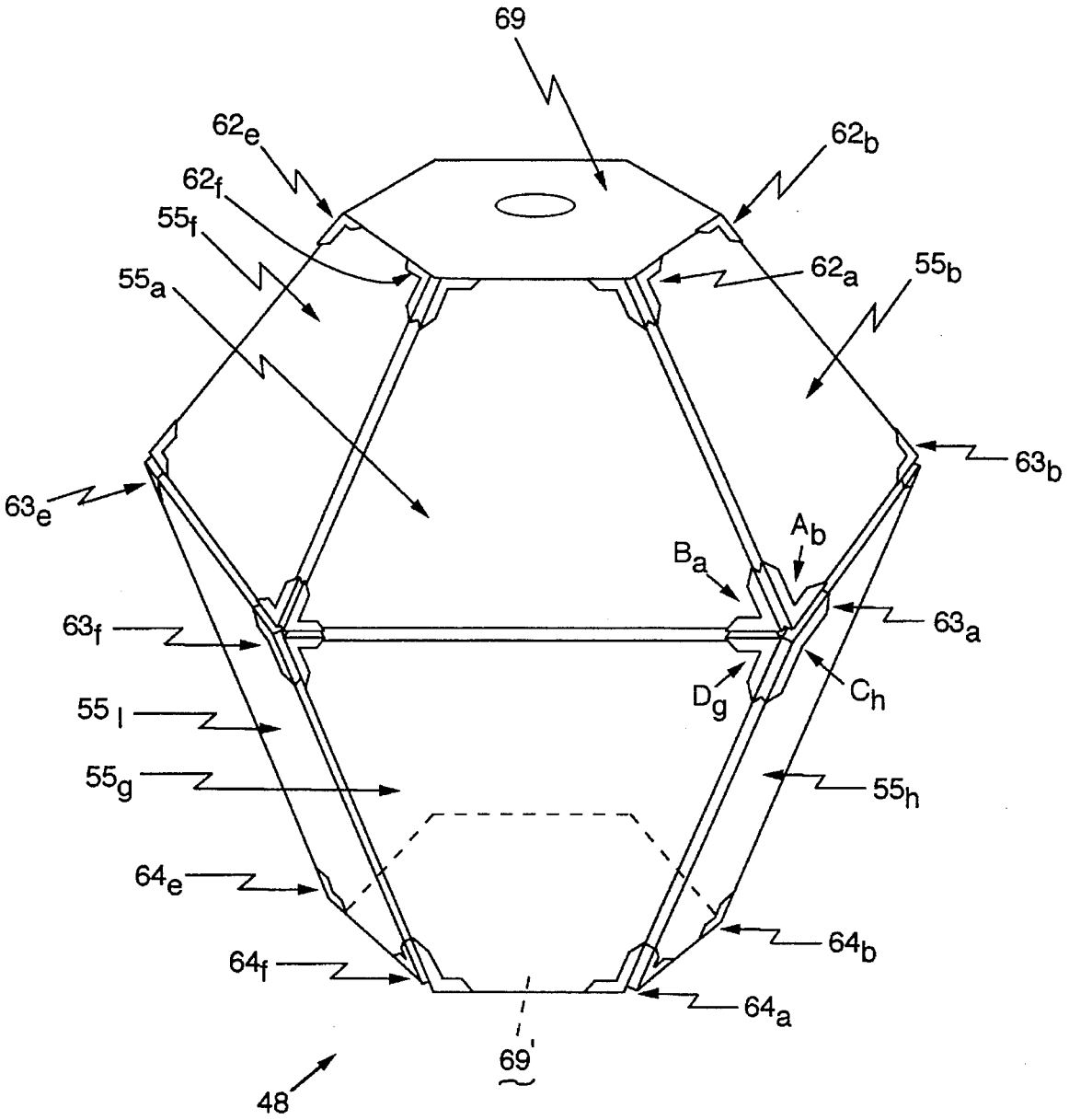
FIG. 5 shows a side perspective view of a lighting fixture in accordance with another embodiment of the invention.

FIG. 5 shows a lighting fixture 48 in accordance with another embodiment of the invention, taken in side perspective view. Lighting fixture 48 according to the illustrated embodiment of the present invention is a double-tiered, six sided, hexagonal polyhedral arrangement of twelve panels 55. The embodiment of the invention shown is directed toward a twelve panel arrangement, the panels respectively 55*a*–551 (panels 55*c*–55*e* and 55*i*–55*k* on the backside of lighting fixture 48 not shown). Panels 55*a*–551 are collectively referred to as panels 55 for convenience. Panels 55 are shown in the shape of truncated isosceles triangles or trapezoids. Each of the panels 55 shown has four corners and four edges, these respectively designated by capital letters A–D for the corners, and Roman numerals I–IV for the edges. The edge and corner designations indicated may be provided with subscripts to indicate a particular corner of a particular panel, e.g., Ca for corner C of panel 55*a*, or IIIa for edge III of panel 55*a*. Alternatively, the corner and edges may be referred to generally without use of subscripts when the general case of the corner or edge is in discussion. Panels of lighting fixture 48 are connected at their respective corners A–D with corner tabs 62, 63, and 64. Corner tabs 62 are also referred to particularly as corner tabs 62*a*–62*f*, in accordance with FIG. 5 (corner tabs 62*c* and 62*d* on the backside of lighting fixture 48 are not shown). Corner tabs 63 are also referred to particularly as corner tabs 63*a*–63*f*, in accordance with FIG. 5 (corner tabs 63*c* and 63*d* on the backside of lighting fixture 48 are not shown). Corner tabs 64 are also referred to particularly as corner tabs 63*a*–63*f*, in accordance with FIG. 5 (corner tabs 64*c* and 64*d* on the backside of lighting fixture 48 are not shown).

Lighting fixture 48 in FIG. 5 further includes a flat plate 69 which is connected to corner tabs 62, for example, by soldering, or glue, or epoxy. Lighting fixture 48 may further include a flat plate 69' which is connected to corner tabs 64, for example, by soldering, or glue or epoxy. Flat plates 69 and 69' may be hexagonal in shape and may be fabricated of metal or glass or other structurally suitable material. The central portions of plates 69 and 69' may be cut or hollowed out, leaving the plates in the shape or form of a ring or frame, for example, alternatively, wire-type frames or rings with or without radial wire spokes connected to a central ring or hub may also be used. As can be seen with reference to FIG. 5, flat plate 69' may be different in area than flat plate 69, to accommodate the separation of corner tabs 64 by different distances than for corner tabs 62. Flat plate 69' may be provided with vertical support directly or indirectly from flat plate 69 through support rods, tubes, or ribs as will be discussed in greater detail below in connection with another embodiment of the invention. Such vertical weight bearing members can extend along the vertical junctions of adjacent panels. Alternatively, such weight bearing members or struts can extend vertically internally or externally of the panels and the associated hexagonal polyhedral structure, as more fully described later herein.

Figure 6:
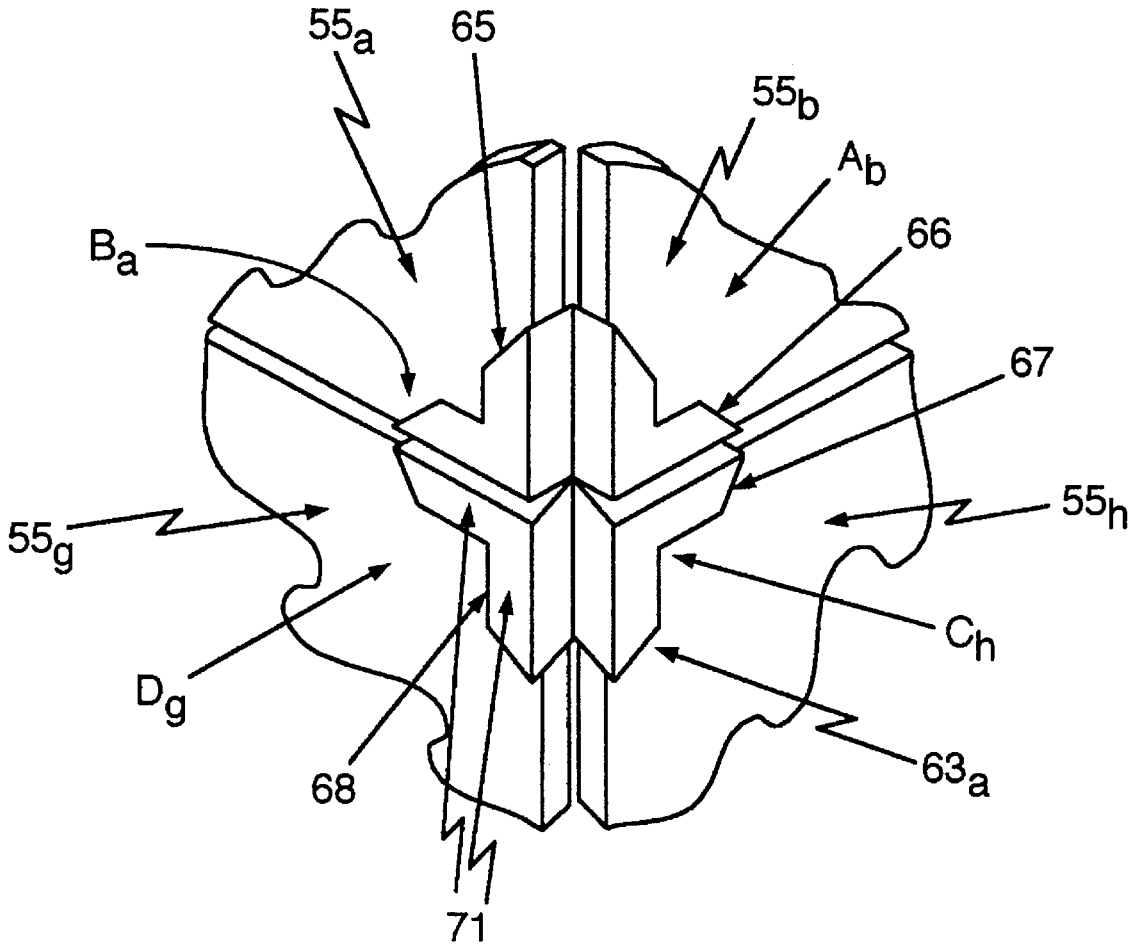
FIG. 6 shows first through fourth portions of adjacent panels connected at adjacent corners with a corner tab according to a selected embodiment of the present invention which features L-shaped sockets.
Figure 7:
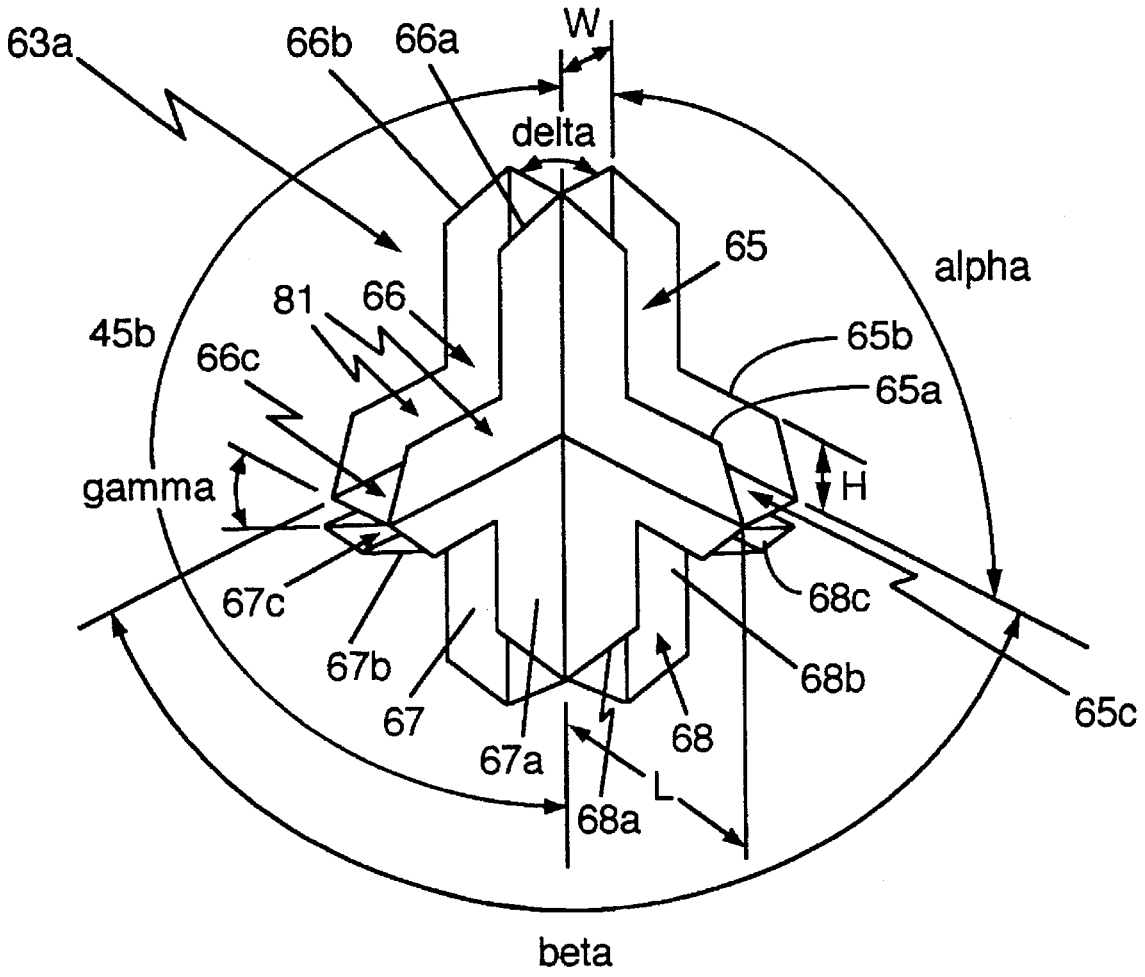
FIG. 7 shows a perspective view of details of the corner tab of FIG. 6 including L-shaped sockets.

FIG. 6 shows first through fourth portions of adjacent panels respectively 55*a*, 55*b*, 55*g*, and 55*h* connected at adjacent respective corners Ba, Ab, Dg, and Ch, with a corner tab 63*a* according to the present invention. Corner tabs 63*a*–63*f* of FIG. 6 include first through fourth L-shaped sockets 65–68, according to one embodiment of the present invention. Each of sockets 65–68 includes first and second flanges, these being respectively designated in pairs as flanges 65*a*, 65*b*; 66*a*, 66*b*; 67*a*, 67*b*; and 68*a* and 68*b*. Further, each of sockets 65–68 includes a central base portion. These central base portions are designated respectively as central base portions 65*c*, 66*c*, 67*c*, and 68*c*. Each socket can be made separately, and then the four sockets can be attached, for example, by soldering them together at adjacent edges thereof. According to another embodiment, the front portions of the sockets including flanges 65*a*–68*a* can be separately manufactured from the rear portions including flanges 65*b*–68*b*. Then, the central base portions 65*c*–68*c* may be fabricated, and the front and rear portions may be joined as flanges to central base portions 65*c*–68*c*. Alternatively, the combined corner sockets may be manufactured in one piece such as by one-piece moldings using conventional injection molding or die-casting techniques, for example. As seen in FIG. 7, sockets 65–68 are U-shaped in cross-section, according to one embodiment of the present invention. Other cross sectional shapes, such as V-shapes or H-shapes, without limitation, are useful as well, provided suitable adaptations of shapes of the panels which they hold are made. The V-shaped cross sectional embodiment is particularly suited to accommodate beveled panel edges.

FIG. 7 shows a perspective view of details of corner tab 63*a* of FIG. 6 including L-shaped sockets 65–68. For example, socket 66 of corner tab 63*a* further includes side flanges 66*a* and 66*b*. As noted above, sockets 65–68 may be L-shaped. In particular, each of flanges 65*a*, 65*b*, 66*a*, 66*b*, 67*a*, 67*b*, 68*a*, and 68*b* may be L-shaped. The shape of the L includes vertical and horizontal limbs, the vertical limb and the horizontal limbs being equally long, according to one version of the invention. The vertical and horizontal limbs are joined at a proximal end, and each limb has side and distal edges. The distal and side edges may be variously angled from the limb axis. According to one embodiment, the distal edge angle with respect to the limb axis is 90 degrees. In other words, the distal edge is perpendicular to the limb axis. The limb axis may be parallel to the side edges. According to another embodiment, the distal edge may be fabricated at 45 degrees or at other suitable angles relative to the limb axis. The corner tabs shown in FIGS. 6 and 7 may be referred to as quadruples, because they connect four corners of adjacent panels. The height of an L-shaped limb is indicated in FIG. 7 by a capital "H," the width between limbs, by capital "W," and the limb length, by capital "L." Angle beta is an example of a planar angle of inclination between adjacent panel planes, as reflected in the respective angular dispositions of the adjacent corner tab sockets. Angle alpha is a corner apex angle of a particular panel shown at the indicated corner thereof.

Figure 8:
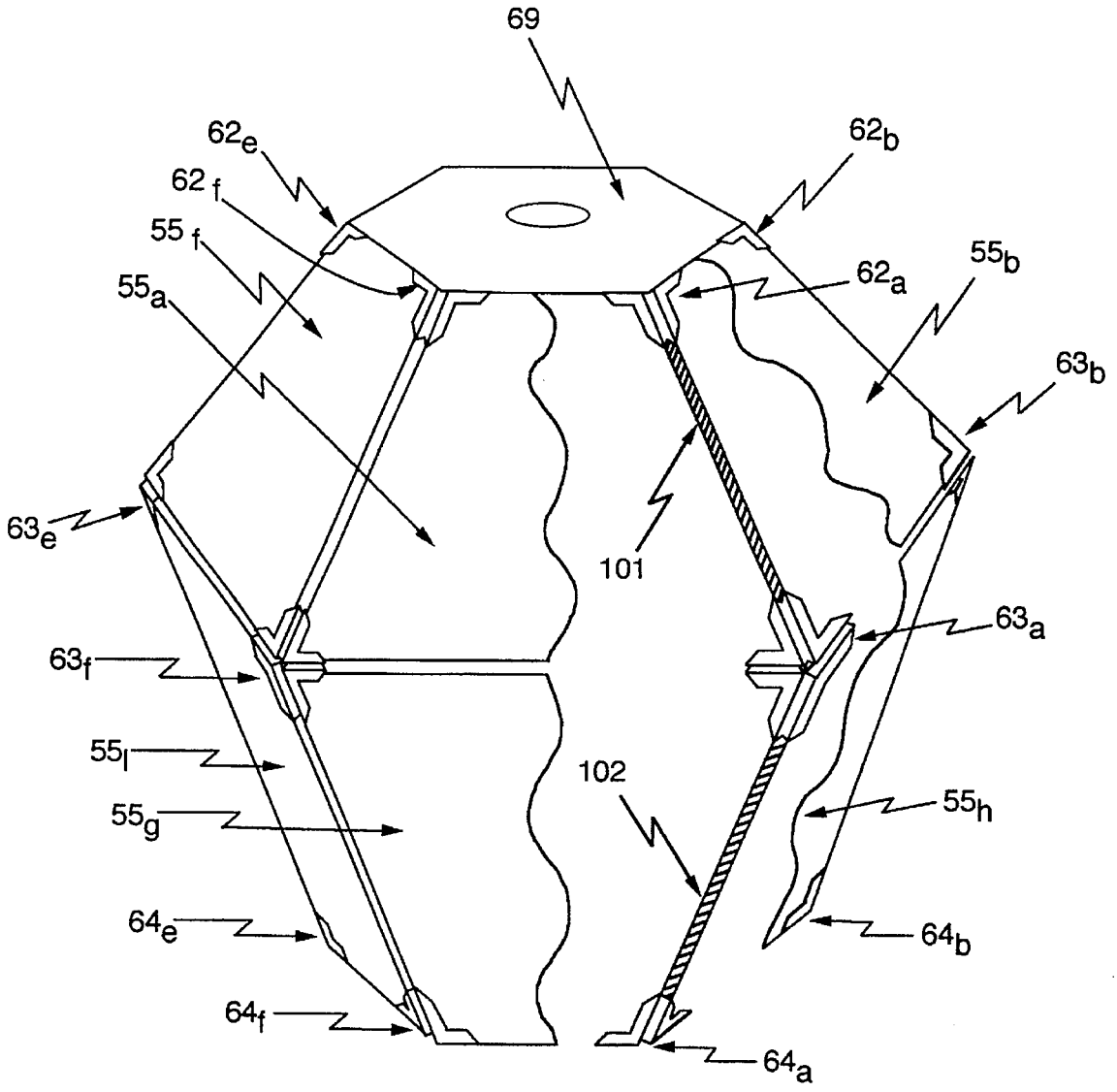
FIG. 8 shows a lighting fixture in accordance with another embodiment of the invention, taken in side perspective view.

FIG. 8 shows lighting fixture 48 with portions of panels 55*a*, 55*b*, 55*g*, and 55*h* broken away to show a version of the invention in which light fixture 48 includes additional support structures 101 and 102 which may be rods, ribs, or tubes, for example and without limitation, configured to extend along the vertical junctions of pairs of horizontally adjacent panels of light fixture 48. Support structures including distal ends 101 and 102 according to one embodiment may be a single unitary piece or rod bent along the lengths to align with the edges of the adjacent panels, or may be separate pieces 101 and 102 that are joined at corner tab 63a. The distal ends 101 and 102 are attached either to corner tabs 62 and 64 or to plates or rings 69 and 69'. Such support structures can alternatively extend along the vertical junctions of adjacent panels or may span independently thereof along any path between panels, plates, or rings 69, 69'. Alternatively, such support structures can extend between upper and lower plates or rings vertically internally or externally of the panels and the associated hexagonal polyhedral structure.

Figure 9:
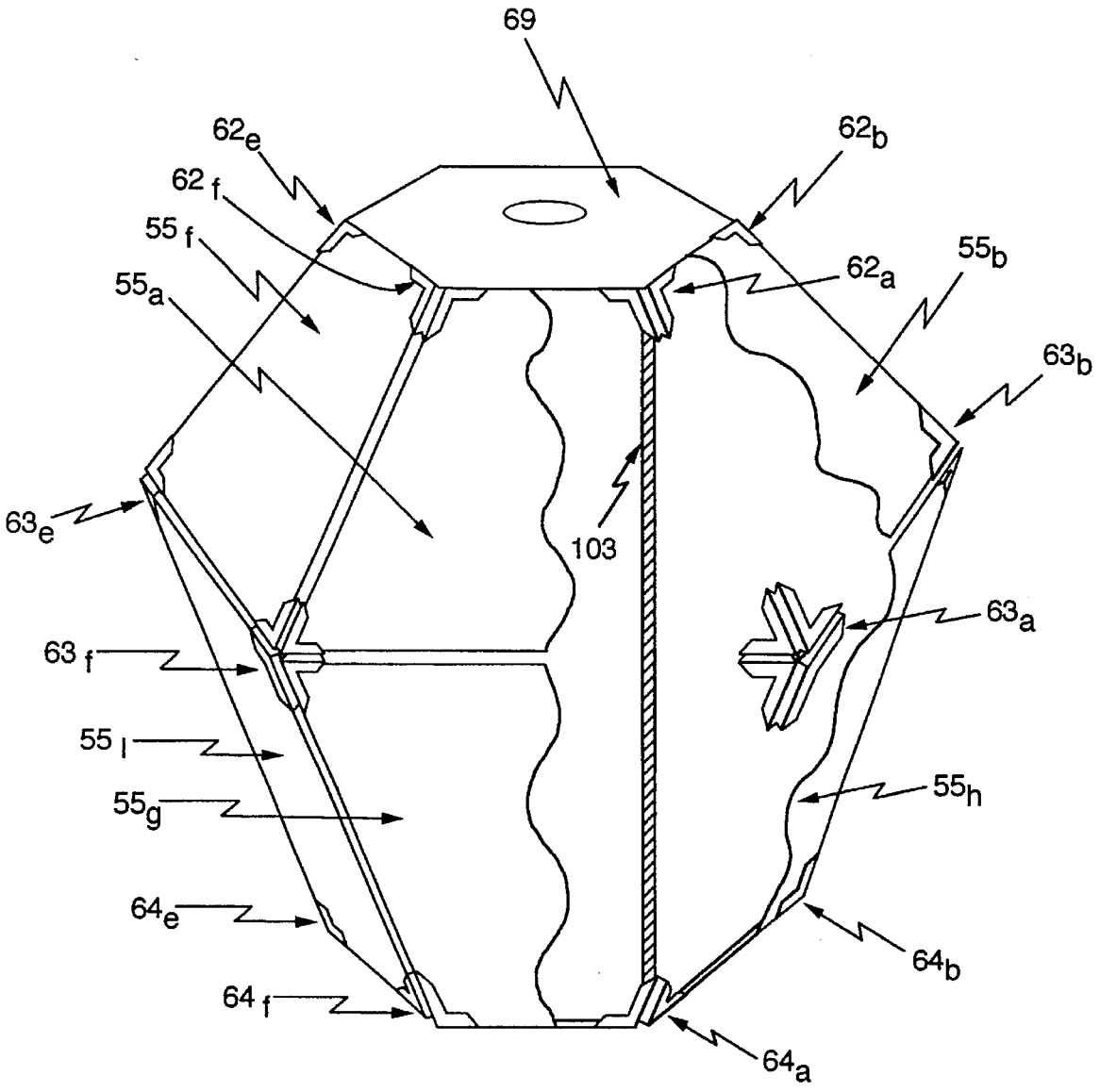
FIG. 9 shows a side perspective view of a lighting fixture in accordance with another embodiment of the invention.

FIG. 9 shows a version of lighting fixture 48 in which portions of panels 55*a*, 55*b*, 55*g* and 55*h* are shown broken away. This embodiment version of lighting fixture 48 employs support structure 103 including a single or plural number of bars or members extending directly from top to bottom of lighting fixture 48 and connecting either corner tabs 62 and 64 directly, or plates or rings 69 and 69' directly, or some combination thereof such as for example corner tab 62 with plate or ring 69' or corner tab 64 with plate or ring 69. A tube, strut, or other elongated member may be employed in lieu of the bar indicated to support the lower tier or tiers of panels positioned above plate or ring 69'.

Figure 10:
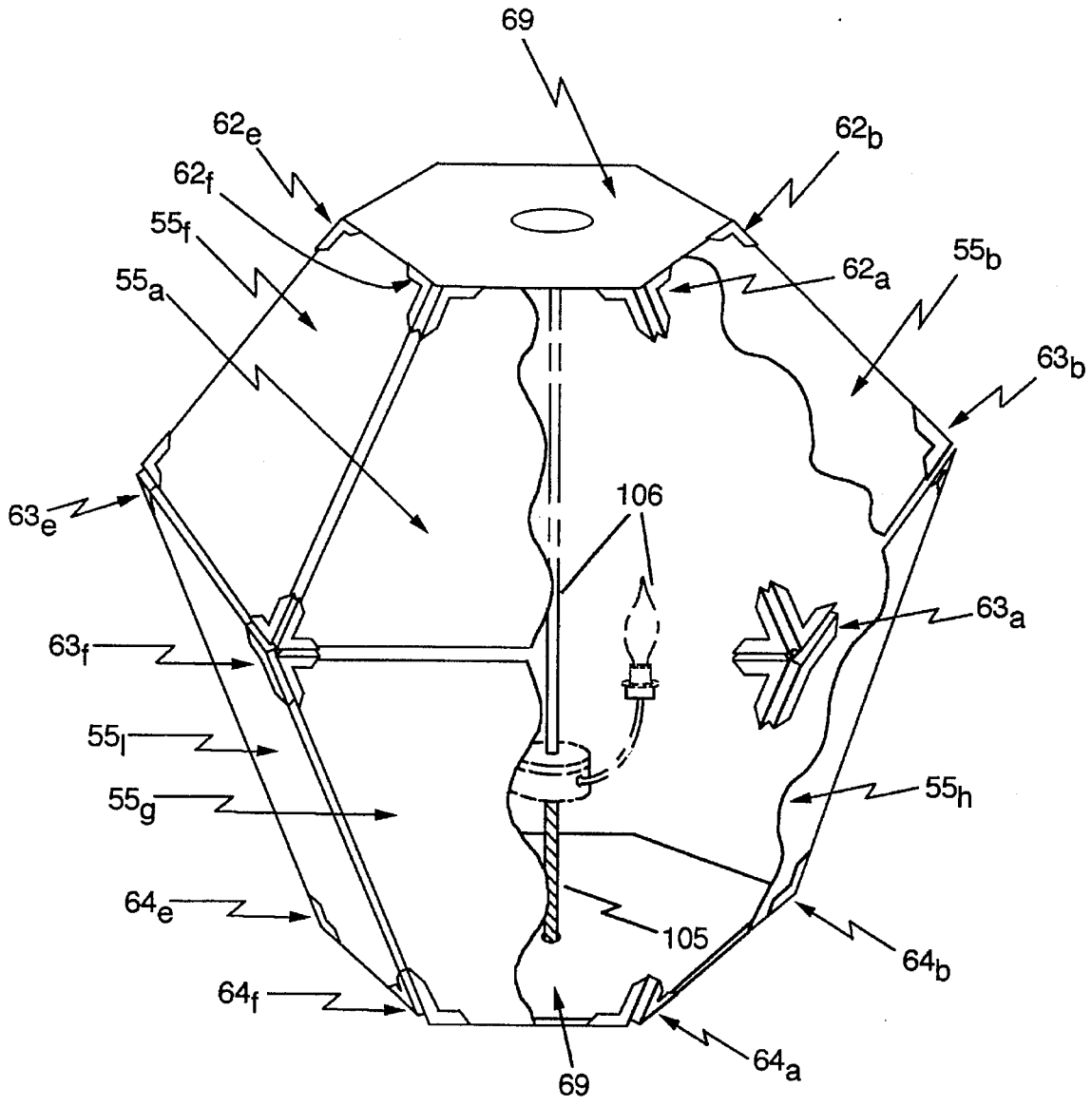
FIG. 10 shows a side perspective view of a lighting fixture in accordance with another embodiment of the invention.

FIG. 10 shows an embodiment of lighting fixture 48 in which portions of panels 55*a*, 55*b*, 55*g*, and 55*h* are shown broken away. This embodiment of lighting fixture 48 employs support structure 105 including a single bar or member extending directly from and connecting the bottom of the centrally-located conventional lighting components or lamp-cluster assembly 106 to plate or ring 69' at or near the central vertical axis thereof. Alternatively, a plurality of vertical support structures 105 may be disposed in parallel between the bottom of the centrally-located conventional lighting components or lamp cluster assembly 106 and the plate or ring 69' to provide support to the lower plate or ring 69' and the tier or tiers of panels positioned above the plate or ring 69'.

In each of the embodiments illustrated or described herein, it should be noted that 'horizontal' and 'vertical' references are for convenience in describing a generally descending structure of attached panels, and that such references throughout should be considered applicable, though oriented by 90° angular displacement (or any other suitable angle), to similar structures of attached panels disposed to be attached to a vertical or tilted wall or ceiling. In addition, it should be noted that tier-by-tier construction illustrated or described herein in generally horizontal orientations is also applicable to construction of vertically oriented segments which are connected together to form larger vertical segments which are then connected together to form the complete structure.

What is claimed is:

1. A lighting structure comprising:

a plurality of panels of selected optical and physical properties each having plurality of edges and corners at intersecting edges, said plurality of panels being coupled in a series including first and last panels of said series, each panel of said series being coupled to an adjacent one of said panels in said series near selected corners of the adjacent, coupled panels;

a plurality of corner structures for coupling adjacent ones of said panels in said series at predetermined angles to each other, each of said corner structures including at least first and second sockets, each of said first and second sockets including first and second flange members for straddling connection to opposite sides of one of at least first and second panels being coupled, with adjacent ones of said at least first and second sockets being coupled to each other for coupling together the adjacent panels near selected corners thereof; each of said at least first and second sockets including a central base portion, adjacent ones of said at least first and second sockets being coupled to each other, wherein said central base portion includes first and second regions which are disposed with respect to each other at a predetermined angle which conforms to the angle of intersecting edges of a panel to which the corner structure may be coupled; and an adhesive attaching corresponding ones of said plurality of corner structures and said plurality of panels.

2. A lighting structure comprising a plurality of panels of selected optical and physical properties each having plurality of edges and corners at intersecting edges, said plurality of panels being coupled in a series including first and last panels of said series, each panel of said series being coupled to an adjacent one of said panels in said series near selected corners of the adjacent, coupled panels;

a plurality of corner structures for coupling adjacent ones of said panels in said series at predetermined angles to each other, each of said corner structures including at least first and second sockets, each of said first and second sockets including first and second flange members for straddling connection to opposite sides of one of at least first and second panels being coupled, with adjacent ones of said at least first and second sockets being coupled to each other for coupling together the adjacent panels near selected corners thereof; each of said at least first and second sockets including a central base portion, adjacent ones of said at least first and second sockets being coupled to each other, wherein said central base portion includes first and second regions which are disposed with respect to each other at a predetermined angle which conforms to the angle of intersecting edges of a panel to which the corner structure may be coupled;

an adhesive attaching corresponding ones of said plurality of corner structures and said plurality of panels, and at least one horizontal structure each securing corner structures connecting selected corners substantially within at least one common plane;

wherein at least one of the number of horizontal structures includes a selected number of said panels connected by a plurality of said corner structures.

3. A lighting structure comprising:

a plurality of panels of selected optical and physical properties each having a plurality of edges and corners at intersecting edges, said plurality of panels being coupled in a series including first and last panels of said series, each panel of said series being coupled to an adjacent one of said panels in said series near selected corners of the adjacent, coupled panels;

a plurality of corner structures for coupling adjacent ones of said panels in said series at predetermined angles to each other, each of said corner structures including at least first and second sockets, each of said first and second sockets including first and second flange members for straddling connection to opposite sides of one of at least first and second panels being coupled, with adjacent ones of said at least first and second sockets being coupled to each other for coupling together the adjacent panels near selected corners thereof; and an adhesive attaching corresponding ones of said plurality of corner structures and said plurality of panels;

said lighting structure further including a plurality of non-elastic members for connecting corner structures.

4. A lighting structure comprising:

a plurality of panels of selected optical and physical properties each having plurality of edges and corners at intersecting edges, said plurality of panels being coupled in a series including first and last panels of said series, each panel of said series being coupled to an adjacent one of said panels in said series near selected corners of the adjacent, coupled panels;

a plurality of corner structures for coupling adjacent ones of said panels in said series at predetermined angles to each other, each of said corner structures including at least first and second sockets, each of said first and second sockets including first and second flange members for straddling connection to opposite sides of one of at least first and second panels being coupled, with adjacent ones of said at least first and second sockets being coupled to each other for coupling together the adjacent panels near selected corners thereof;

at least one horizontal structure each securing corner structures connecting selected corners substantially within at least one common plane; and at least one non-elastic member for connecting at least one of the number of horizontal structures with a corner structure.

5. A multi-tiered lighting structure comprising:

at least first and second pluralities of panels of selected physical and optical properties, each panel having plurality of edges and corners at intersecting edges, said plurality of panels being coupled in a series including first and last panels of said series, each panel of said series being coupled to an adjacent one of said panels in said series near selected corners of the adjacent, coupled panels;

a plurality of corner structures for coupling adjacent panels in said series at predetermined angles to each other, within a single horizontal tier;

a plurality of inter-tier corner structures connecting adjacent ones of said panels in said series at predetermined angles to each other, across two tiers, each of said corner structures including at least first and second sockets, each of said inter-tier corner structures including at least first through fourth sockets, each of said at least first and second and first through fourth sockets including first and second flange members for straddling connection to opposite sides of said panels being coupled, with adjacent ones of said at least first and second and first through fourth sockets being coupled to each other for connecting together the adjacent panels within and across the multiple tiers near selected corners thereof; and means for adheringly connecting corresponding ones of said plurality of corner structures and said plurality of panels.

6. A multi-tiered lighting structure comprising:

at least first and second pluralities of panels of selected physical and optical properties, each panel having plurality of edges and corners at intersecting edges, said plurality of panels being coupled in a series including first and last panels of said series, each panel of said series being coupled to an adjacent one of said panels in said series near selected corners of the adjacent, coupled panels;

a plurality of corner structures for coupling adjacent panels in said series at predetermined angles to each other, within a single horizontal tier;

a plurality of inter-tier corner structures coupling adjacent ones of said panels in said series at predetermined angles to each other, across adjacent tiers, each of said corner structures including at least first and second sockets, each of said inter-tier corner structures including at least first through fourth sockets, each of said at least first and second and first through fourth sockets including first and second flange members for straddling connection to opposite sides of said panels being coupled, with adjacent ones of said at least first and second and first through fourth sockets being coupled to each other for coupling together the adjacent panels within and across the multiple tiers near selected corners thereof;

at least one horizontal structure each securing corner structures connecting selected corners substantially within at least one common plane, wherein at least one of the number of horizontal structures includes a selected number of said panels coupled by a plurality of said corner structures; and an adhesive attaching corresponding ones of said plurality of corner structures and said plurality of panels.

7. The multi-tiered lighting structure according to claim 5 including a plurality of non-elastic members for connecting corner structures.

8. A multi-tiered lighting structure comprising:

at least first and second pluralities of panels at selected physical and optical properties, each panel having plurality of edges and corners at intersecting edges, said plurality of panels being coupled in a series including first and last panels of said series, each panel of said series being coupled to an adjacent one of said panels in said series near selected corners of the adjacent, coupled panels;

a plurality of corner structures for coupling adjacent panels in said series at predetermined angles to each other, within a single horizontal tier;

a plurality of inter-tier corner structures coupling adjacent ones of said panels in said series at predetermined angles to each other, across two tiers, each of said corner structures including at least first and second sockets, each of said inter-tier corner structures including at least first through fourth sockets, each of said at least first and second and first through fourth sockets including first and second flange members for straddling connection to opposite sides of said panels being coupled, with adjacent ones of said at least first and second and first through fourth sockets being coupled to each other for coupling together the adjacent panels within and across the multiple tiers near selected corners thereof;

at least one horizontal structure each securing corner structures connecting selected corners substantially within at least one common plane and;

at least one member for connecting at least one of the number of horizontal structures with a corner structure.

9. A corner structure for coupling adjacent panels in a lighting fixture at predetermined angles to each other, the corner structure comprising:

at least first and second sockets, each of said first and second sockets including first and second flange members for straddling connection to opposite sides of one of at least first and second panels being coupled, each of said at least first and second sockets including a central base portion, adjacent ones of said at least first and second sockets being coupled to each other for coupling together the adjacent panels near selected corners thereof, each of said first and second flange members being connected to corresponding ones of said central base portions, wherein said central base portion includes first and second regions which are disposed with respect to each other at a predetermined angle which conforms to the angle of intersecting edges of a panel to which the corner structure may be coupled.

10. The corner structure of claim 9, wherein at least one of said at least first and second sockets is shaped in cross section in one of substantially U, V, H and rounded configurations in each of said first and second regions.

11. The corner structure of claim 9, wherein at least one of said at least first and second sockets is substantially L-shaped in side profile in each of said first and second regions.

12. A corner structure for coupling adjacent panels in a lighting fixture at predetermined angles to each other, the corner structure comprising:

at least first and second sockets, each of said first and second sockets including first and second flange members for straddling connection to opposite sides of one of at least first and second panels being coupled, each of said at least first and second sockets including a central base portion, adjacent ones of said at least first and second sockets being coupled to each other exclusively at respective central base portions for connecting together the adjacent panels near selected corners thereof, each of said first and second flange members being connected to corresponding ones of said central base portions, wherein said central base portion includes first and second regions which are disposed with respect to each other at a predetermined angle which conforms to the angle of intersecting edges of a panel to which the corner structure may be coupled.

13. The corner structure of claim 9 comprising an adhesive attaching said at least first and second sockets only to corresponding corners of adjacent first and second panels in a lighting fixture.

14. A lighting structure comprising:

a plurality of panels of selected optical and physical properties each having at least one corner at intersecting edges, each of said plurality of panels being coupled to an adjacent one of said panels near a corner of each of the adjacent, coupled panels;

a plurality of corner structures for coupling adjacent ones of said panels at predetermined angles to each other, each of said corner structures including at least first and second sockets, each of said first and second sockets including first and second flange members for straddling connection to opposite sides of one of at least first and second panels being coupled, with adjacent ones of said at least first and second sockets being coupled to each other for coupling together the adjacent panels near selected corners thereof; each of said at least first and second sockets including a central base portion, adjacent ones of said at least first and second sockets being coupled to each other, wherein said central base portions include first and second regions which are disposed with respect to each other at a predetermined angle which conforms to the angle of intersecting edges of a panel to which the corner structure may be coupled; and an adhesive attaching corresponding ones of said plurality of corner structures and said plurality of panels.

15. A lighting structure comprising:

a first plurality of panels of selected physical and optical properties, each panel having at least one corner at intersecting edges, each of said first plurality of panels being coupled to an adjacent one of said panels near a corner of each of the adjacent, coupled panels;

a first plurality of corner structures for coupling adjacent ones of the first plurality of panels at predetermined angles to each other;

a second plurality of panels of selected physical and optical properties, each panel having at least one edge;

a second plurality of corner structures coupling selected ones of said panels in said first plurality of panels at predetermined angles to adjacent panels in said second plurality of panels, each of said second plurality of corner structures including at least first and second sockets, at least one of said sockets being for receiving therein intersecting edges of panels in the first plurality of panels, each of said second plurality of corner structures also including at least a single socket having first and second flange members for straddling connection to opposite sides of one of the second plurality of panels being coupled, with adjacent ones of said sockets of said second plurality of corner structures being coupled to each other for connecting together the adjacent ones of first and second pluralities of panels;

first adhesive attaching corresponding ones of said first plurality of corner structures and said first plurality of panels; and second adhesive attaching corresponding ones of said second plurality of corner structures and first and said second plurality of panels.

16. A coupling structure for connecting adjacent panels near at least one corner of a panel in a lighting fixture at predetermined angles to each other, the coupling structure comprising:

at least first and second sockets, each of said first and second sockets including first and second flange members for straddling connection to opposite sides of one of at least first and second panels being coupled, each of said at least first and second sockets including a central base portion, at least one of said at least first and second sockets receiving intersecting edges of a panel near one corner of such panel; and adjacent ones of said at least first and second sockets being coupled to each other for connecting together the adjacent panels at a selected angular orientation near at least one corner of a panel, each of said first and second flange members being connected to corresponding ones of said central base portions, wherein for each panel connection near at least one corner of a panel corresponding said central base portion includes first and second regions which are disposed with respect to each other at a predetermined angle which conforms to the angle of intersecting edges of said panel to which the coupling structure is coupled.

17. The coupling structure of claim 16, wherein for any panel connection near a non-corner edge of said panel corresponding said central base portions is disposed to conform to said non-corner edge of said panel to which the coupling structure may be coupled.

18. A lighting structure comprising:

a plurality of panels of selected optical and physical properties each having a plurality of edges and corners at intersecting edges, said plurality of panels being coupled in a series including first and last panels of said series, the corners of said plurality of panels defining at least first and second independent planes, each panel of said series being coupled to an adjacent one of said panels in said series near selected corners of the adjacent, coupled panels;

a plurality of corner structures for coupling adjacent ones of said panels in said series at predetermined angles to each other, each of said corner structures including at least first and second sockets, each of said at least first and second sockets including first and second flange members for straddling connection to opposite sides of one of at least first and second panels being coupled, with adjacent ones of said at least first and second sockets in each of said corner structures being coupled to each other for coupling together the adjacent panels near selected corners thereof;

first and second horizontal structures each securing corner structures connecting selected corners substantially within at least one common plane, said first horizontal structure securing corner structures in said first plane and said second horizontal structure securing corner structures in said second plane; and at least one member for connecting said first and second horizontal structures.

19. A multi-tiered lighting structure comprising:

at least first and second pluralities of panels of selected physical and optical properties, each panel having plurality of edges and corners at intersecting edges, said plurality of panels being coupled in a series including first and last panels of said series, the corners of said plurality of panels defining at least first and second independent planes, each panel of said series being coupled to an adjacent one of said panels in said series near selected corners of the adjacent, coupled panels;

a plurality of corner structures for coupling adjacent panels in said series at predetermined angles to each other, within a single horizontal tier;

a plurality of inter-tier corner structures coupling adjacent ones of said panels in said series at predetermined angles to each other, across adjacent tiers, each of said corner structures including at least first and second sockets, each of said inter-tier corner structures including at least first through fourth sockets, each of said at least first and second and first through fourth sockets including first and second flange members for straddling connection to opposite sides of said panels being coupled, with adjacent ones of said at least first and second and first through fourth sockets in each of said corner structures and inter-tier corner structures being coupled to each other for coupling together the adjacent panels within and across the multiple tiers near selected corners thereof;

first and second horizontal structures each securing corner structures connecting selected corners substantially within at least one common plane, said first horizontal structure securing corner structures in said first plane and said second horizontal structure securing corner structures in said second plane; and at least one member for connecting said first and second horizontal structures.

20. The coupling structure of claim 16, wherein said first and second sockets are coupled directly at said respective at least first and second central base portions.

21. The coupling structure of claim 16, wherein said first and second sockets are coupled with said respective at least first and second central base portions through respective central base portion coupling members.

22. The corner structure of claim 9, wherein said first and second sockets are coupled directly at said respective at least first and second central base portions.

23. The corner structure of claim 9, wherein said first and second sockets are coupled with said respective at least first and second central base portions through respective central base portion coupling members.

24. The coupling structure of claim 16, wherein at least one of said at least first and second central base portions are disposed to conform in cross section in one of substantially U, V, H and rounded configurations in each of said first and second regions.

25. The coupling structure of claim 16, wherein at least one of said at least first and second central base portions is substantially L-shaped in side profile in each of said first and second regions.

26. The coupling structure of claim 16 comprising an adhesive attaching said at least first and second sockets only to corresponding corners and edges of adjacent first and second panels in a lighting fixture.

* * * * *